US005722592A

United States Patent [19]

Jäger

[11] Patent Number: 5,722,592

[45] Date of Patent: Mar. 3, 1998

[54] ROTOR NOZZLE, IN PARTICULAR FOR A HIGH PRESSURE CLEANING APPARATUS

[76] Inventor: Anton Jäger, Dorfstrasse 9, Senden-Hittistetten, Germany, 89250

[21] Appl. No.: 624,037

[22] Filed: Mar. 27, 1996

[30] Foreign Application Priority Data

Mar. 30, 1995 [DE] Germany ..... 195 11 820.0

[51] Int. Cl.[6] ..... B05B 3/00

[52] U.S. Cl. ..... 239/227; 239/240

[58] Field of Search ..... 239/227, 233, 239/237, 240, 251, 261, 263, 264, 380–383

[56] References Cited

U.S. PATENT DOCUMENTS

| | | | |
|---|---|---|---|
| 4,802,628 | 2/1989 | Dautel et al. | 239/227 |
| 4,989,786 | 2/1991 | Kranzle et al. | 239/240 |
| 5,332,155 | 7/1994 | Jager | 239/381 X |
| 5,395,053 | 3/1995 | Frech | 239/227 |

*Primary Examiner*—Andres Kashnikow
*Assistant Examiner*—Steven J. Ganey
*Attorney, Agent, or Firm*—Townsend and Townsend and Crew LLP

[57] ABSTRACT

The rotor nozzle is in particular provided for a high pressure cleaning apparatus. It consists of a nozzle housing (1) which has a central inlet opening (2) at its one axial end and an outlet opening (3) for the cleaning liquid at the other end. In the nozzle housing (1) there is arranged a rotor (4) which is inclined relative to the longitudinal axis (14) of the nozzle housing, which is rotationally driven and which rolls off around the wall of the housing. The rotor (4) is provided with a nozzle (6) arranged in a support (5) with the cleaning liquid flowing through the nozzle (6) and with the end of the nozzle pointing towards the outlet opening (3) being pivotally supported in a cup bearing (7). At its end towards the outlet opening the rotor (4) is of sleeve-like design and is journalled there at its end in the manner of a ball joint on a bearing sleeve (8). The bearing cup (7) is arranged concentrically in the bearing sleeve (8). The rotor (4) has at its inner side co-movement or guide surfaces for the support (5).

10 Claims, 1 Drawing Sheet

ROTOR NOZZLE, IN PARTICULAR FOR A HIGH PRESSURE CLEANING APPARATUS

Figures 1, 2:
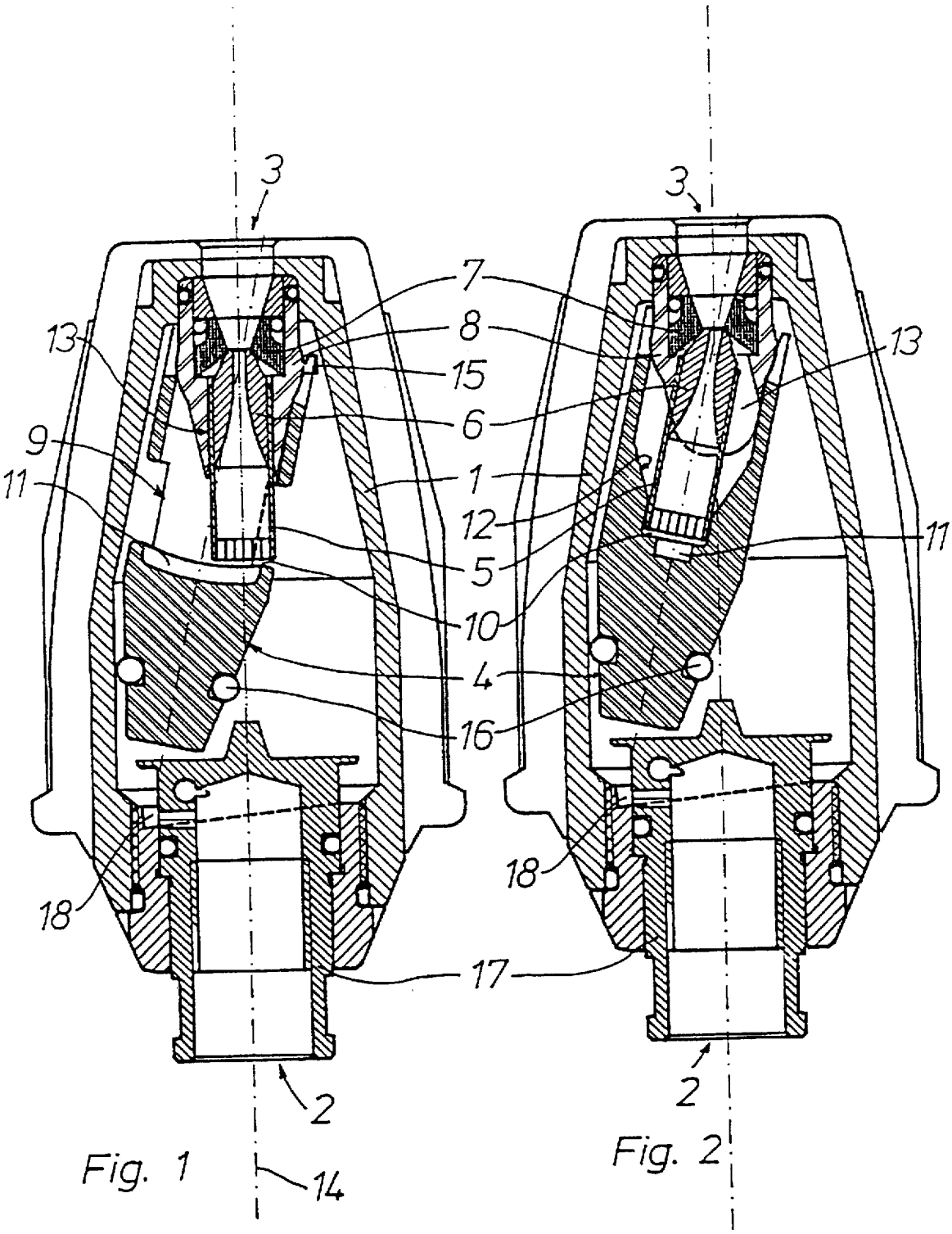

The invention relates to a rotor nozzle, in particular for a high pressure cleaning apparatus, comprising a nozzle housing which has a central inlet opening at its one axial end and an outlet opening for the cleaning liquid at the other end, and also comprising a rotor arranged within the nozzle housing and inclined relative to its longitudinal axis, with the rotor being rotationally driven and rolling off on the inner wall of the housing, wherein the rotor is provided with a nozzle through which the cleaning liquid flows and which is arranged in a support, with the end of the nozzle pointing towards the outlet opening being pivotally supported in a cup bearing.

A rotor nozzle of this kind is, for example, described in DE-44 33 646. Basically, it is favourable for many uses of such rotor nozzles to reduce the high speed of rotation of the rotor which is, as a rule, caused by the type of construction. Various differing measures have already been proposed for this purpose. However, as a result, the rotor nozzle is, as a rule, subject to a restriction in that influencing of the spray pattern is no longer possible or is hardly still possible.

Starting from this, the invention is based on the object of so further developing a rotor nozzle of the initially named kind that, even when operated at a reduced speed of rotation, different spray patterns can be selected.

This object is satisfied in accordance with the invention in that the rotor is of sleeve-like form at its end pointing towards the outlet opening and is journalled there on a bearing sleeve at its end in the manner of a ball joint, with the cup bearing being arranged concentrically within the bearing sleeve and with the rotor having at its inner side co-movement or guide surfaces for the support.

The advantage achieved by the invention consists essentially in the fact that, on the one hand, it is possible, via the journalling of the rotor at the bearing sleeve, to influence the course of movement of the rotor which is rotationally driven by the cleaning liquid flowing through it, and in the fact that, on the other hand, the course of movement of the support, which is directly responsible for the spray pattern that is achieved, is influenced by the guide surfaces provided on the rotor at the inner side. Through the individual layout of the guide or follower surfaces, the spray pattern can thus be influenced within broad limits.

In a preferred embodiment of the invention, the convex surface of the ball joint is arranged at the outside either at the bearing housing or at the rotor and correspondingly the concave surface is arranged at the inner side either at the rotor or at the bearing sleeve. In this arrangement it is furthermore advantageous when the bearing sleeve has a conically tapering region which adjoins the convex surface remote from the outlet opening.

Furthermore, provision is made in the context of the invention for the rotor to have one or more radially extending inflow openings for the cleaning liquid in its sleeve-like region.

When the guide surface surrounds the support, one obtains a conventional, substantially circular round spray pattern.

However, in the context of the invention, the advantageous possibility exists for the rotor to have a radially extending slide groove for the end of the support remote from the nozzle opening, whereby the groove walls form the co-movement or guide surfaces for the support. The slide groove thereby expediently extends in a circular arc-like manner at a radius which corresponds to the total length of the support, so that the end face of the support, via which the cleaning liquid flows in in the direction towards the nozzle, always has the same distance from the base of the slide groove. The slide groove can thereby extend up to the outer jacket surface of the rotor so that the end of the slide groove simultaneously forms the inflow opening for the cleaning liquid.

In order to further promote the inflow of the cleaning fluid into the interior of the support, a flow groove which is narrower than the slide groove is advantageously arranged in the base of the slide groove. This flow groove is expediently arranged approximately centrally with respect to the slide groove and is closed at its two ends. In this arrangement, conical surfaces which broaden into the sleeve-like region of the rotor adjoin the upper edge of the groove walls of the slide groove.

Finally, in accordance with a further embodiment, the spray pattern can be influenced by designing the bearing sleeve to have two parallel boundary surfaces which accommodate the support between them and which are aligned relative to the longitudinal axis of the nozzle housing at an angle of 90° relative to the slide groove, with the bearing sleeve being rotationally connected to a rotor. These boundary surfaces permit the support to execute only a pendulum movement, whereby a linear spray pattern of the rotor nozzle results. Through the alignment of the slide groove in the rotor at an angle of 90° relative to these boundary surfaces it is reliably ensured that the rotor can run along a conical surface, despite the restriction of the support to a pendulum movement.

In order to ensure a rotational connection between the bearing sleeve and the rotor, the bearing sleeve can advantageously have a latched projection in the area of its convex surface which engages into a recess of the rotor. The rotor has, in known manner, at its end remote from the outlet opening, a friction ring inserted into a ring groove via which the rotor runs off on the inner wall of the nozzle housing. This is one of the measures which achieves a reduction of the speed of rotation.

Finally, in accordance with a further layout of the invention, the bearing sleeve can be formed in one piece with the nozzle housing.

In the following the invention will be explained with reference to an embodiment illustrated in the drawing. There are shown:

FIG. 1 a longitudinal section through the rotor nozzle

FIG. 2 a further longitudinal section through the rotor nozzle perpendicular to the section of FIG. 1.

The rotor nozzle reproduced in the drawing serves in particular for use in conjunction with a high pressure cleaning apparatus. In detail, the rotor nozzle comprises a nozzle housing 1 which has at its one axial end a central inlet opening 2 and at the other end an outlet opening 3 for the cleaning liquid. Within the nozzle housing 1 there is provided a rotor 4 arranged inclined relative to its longitudinal axis, with the rotor 4 being rotationally driven by the cleaning liquid flowing through the nozzle housing and thereby rolling off on the inner wall of the housing. The rotor 4 is provided with a support 5 within which a nozzle 6 is arranged through which the cleaning liquid likewise flows and which discharges the latter through the outlet opening 3 towards the outside. The nozzle 6 is itself pivotally supported for this purpose in a cup bearing 7 at its end pointing towards the outlet opening 3.

The rotor 4 is of sleeve-like design at its end pointing towards the outlet opening 3 and is journalled there at the end in the manner of a ball joint on a bearing sleeve 8. The cup bearing 7 is in turn concentrically arranged in the bearing sleeve 8. In order to be able to move the support 5 in accordance with the desired spray pattern, the rotor 4 has co-movement or guide surfaces for the support 5 at its inner side.

The bearing sleeve 8 carries at the outside the convex surface of the ball joint, whereas the rotor 4 has a corresponding concave surface at the inner side. In just the same way, however, the rotor 4 could have a convex surface at the outside which contacts a concave surface of the bearing sleeve 8 or of the nozzle housing 1 directly. In order to enable the movement of the rotor 4 along a conical surface, the region of the bearing sleeve 8 remote from the outlet opening 3 which adjoins the convex surface likewise tapers conically.

The rotor 4 has in its sleeve-like region two radial inflow openings 9 through which the cleaning liquid can enter and flow to the end face of the support 5.

The co-movement or guide surfaces of the rotor 4 for the support 5 can be formed in accordance with the desired spray pattern. In the embodiment, the rotor 4 has a radially extending slide groove 10 for the end of the support 5 remote from the nozzle opening and here the groove walls form the co-movement or guide surfaces for the support 5. In addition to the course of movement caused by the rotor 4, the support 5 can here also execute a linear movement within the rotor 4. This leads in the end result to an elliptical or lens-shaped spray pattern of the rotor nozzle, since the support 5 on rotation of the rotor 4 will only participate in the full movement stroke in the one direction, whereas in the direction perpendicular to it, it will deviate to some extent via the slide groove 10, i.e. will not achieve the maximum deflection.

The slide groove 10 extends in circular arc-like manner at a radius which corresponds to the full length of the support 5, so that the space between the end face of the support 5 and the groove base is constant independently of the position of the support 5. The slide groove 10 extends up to the outer jacket surface of the rotor 4 so that the end of the slide groove 10 simultaneously forms the inflow opening 9 into the rotor 4. In order to further improve the inflow of the cleaning liquid into the end face of the support 5, a flow groove 11 is arranged in the base of the slide groove 10 which is narrower than the latter. This flow groove 11 extends approximately centrally to the slide groove 10 and is, in each case, closed at its ends. Conical surfaces 12 which broaden into the sleeve-like region of the rotor 4 adjoin the upper edge of the groove walls of the slide groove 10 as can be seen in FIG. 2.

When a linear spray pattern is desired in place of an elliptical or lenticular spray pattern, which is achieved by the use of the slide groove 10, then, in accordance with the illustrated embodiment, two parallel boundary surfaces 13 which accommodate the support 5 between them and which are aligned with respect to the longitudinal axis 14 of the nozzle housing at an angle of 90° relative to the slide groove 10 are additionally provided at the bearing sleeve 8. The bearing sleeve 8 is in this arrangement rotationally connected to the rotor 4 for which purpose the bearing sleeve 8 has in the region of its convex surface a latch projection 15 which engages into a cut-out of the rotor 4.

The two boundary surfaces 13 only permit the support 5 to execute a pendulum movement, so that in result a linear spray pattern sets in. Through the alignment of the slide groove 10 relative to the boundary surfaces 13 at an angle of 90° it is reliably ensured that the rotor 4 can nevertheless run off along a conical surface. The rotational connection between the rotor 4 and the bearing sleeve 8 is required, in order to maintain this angle of 90°.

In other respects the rotor 4 has a friction ring 16 at its end remote from the outlet opening 3. The friction ring 16 is inserted into a ring groove. The rotor 4 rolls off on the inner wall of the nozzle housing via this friction ring 16. This results in a wear-free operation on the one hand and a reduction of the speed of rotation on the other hand.

The inlet opening 2 of the rotor nozzle has an inlet stub 17 via which the cleaning liquid enters tangentially into the interior of the nozzle housing 1. In this way, a driving of the rotor takes place in accordance with the eddy chamber principle. The invention is, however, in similar manner also utilizable with other drive principles, for example using bladed wheels. The inlet stub 17 is so designed that, through its rotation, the cross-sectional area 18 by which the cleaning liquid enters out of the inlet stub 17 into the nozzle housing 1 is varied and thus the throughflow quantity of the cleaning liquid can be changed.

The possibility also exists, which is not shown in the drawing, of making the bearing sleeve 8 in one piece with the nozzle housing 1.

I claim:

1. Rotor nozzle, comprising a nozzle housing (1) which has a central inlet opening (2) at its one axial end and an outlet opening (3) for the cleaning liquid at the other end, and also comprising a rotor arranged within the nozzle housing (1) and inclined relative to its longitudinal axis (14), with the rotor being rotationally driven and rolling off on the inner wall of the housing, wherein the rotor is provided with a nozzle (6) through which the cleaning liquid flows and which is arranged in a support (5), with the end of the nozzle pointing towards the outlet opening (3) being pivotally supported in a cup bearing (7), characterised in that the rotor is of sleeve-like form at its end pointing towards the outlet opening (3) and is journalled there on a bearing sleeve (8) at its end in the manner of a ball joint, with the cup bearing (7) being arranged concentrically within the bearing sleeve (8) and with the rotor (4) having at its inner side co-movement surfaces for the support (5).

2. Rotor nozzle in accordance with claim 1, characterised in that the convex surface of the ball joint is arranged at the outside either at the bearing sleeve (8) or at the rotor (4) and correspondingly the concave surface is arranged at the inner side either at the rotor (4) or at the bearing sleeve (8).

3. Rotor nozzle in accordance with claim 2, characterised in that the region of the bearing sleeve (8) which adjoins the convex surface and is remote from the outlet opening (3) tapers conically.

4. Rotor nozzle in accordance with claim 1, characterised in that the rotor (4) has one or more radially extending inflow openings (9) for the cleaning fluid in its sleeve-like region.

5. Rotor nozzle in accordance with claim 1, characterised in that the rotor (4) has a radially extending slide groove (10) for the end of the support (5) remote from the nozzle opening, with the groove walls forming the co-movement surfaces for the support (5).

6. Rotor nozzle in accordance with claim 5, characterised in that the sliding groove (10) extends in circular arc-like manner relative to the cup bearing (7) for the support at a radius which corresponds to the total length of the support (5), and in that the slide groove (10) extends up to the outer jacket surface of the rotor (4).

7. Rotor nozzle in accordance with claim 5, characterised in that a flow groove (11) is arranged in the base of the slide groove (10) and is narrower in comparison to the latter.

8. Rotor nozzle in accordance with claim 7, characterised in that the flow groove (11) is arranged approximately centrally relative to the slide groove (10) and is in each case closed at its ends.

9. Rotor nozzle in accordance with claim 5, characterised in that the bearing sleeve (8) has two parallel boundary surfaces (13) which accommodate the support (5) between them, with the two boundary surfaces (13) being aligned relative to the longitudinal axis (14) of the nozzle housing at an angle of 90° relative to the slide groove (10), with the bearing sleeve (8) being rotationally connected to the rotor (4).

10. Rotor nozzle in accordance with claim 9, characterised in that the bearing sleeve (8) has in the region of its convex surface a latch projection (15) which engages into a cut-out of the rotor.

* * * * *